US010711790B2

(12) United States Patent
Hakozaki et al.

(10) Patent No.: US 10,711,790 B2
(45) Date of Patent: Jul. 14, 2020

(54) SERIAL AXIAL FLOW FAN

(71) Applicant: Nidec Corporation, Kyoto (JP)

(72) Inventors: Shogo Hakozaki, Kyoto (JP); Tsukasa Takaoka, Kyoto (JP); Ryota Yamagata, Kyoto (JP); Shoki Yamazaki, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 110 days.

(21) Appl. No.: 16/136,321

(22) Filed: Sep. 20, 2018

(65) Prior Publication Data

US 2019/0085851 A1 Mar. 21, 2019

Related U.S. Application Data

(60) Provisional application No. 62/635,610, filed on Feb. 27, 2018, provisional application No. 62/561,309, filed on Sep. 21, 2017.

(30) Foreign Application Priority Data

Aug. 31, 2018 (JP) ..... 2018-162256

(51) Int. Cl.
*F04D 19/00* (2006.01)
*F04D 25/06* (2006.01)
(Continued)

(52) U.S. Cl.
CPC ..... *F04D 25/0693* (2013.01); *F04D 19/002* (2013.01); *F04D 19/007* (2013.01);
(Continued)

(58) Field of Classification Search
CPC .. F04D 19/002; F04D 19/007; F04D 25/0693; F04D 29/52; F04D 29/522; F04D 29/667
See application file for complete search history.

(56) References Cited

U.S. PATENT DOCUMENTS 6,663,342 B2 12/2003 Huang et al.
2009/0060732 A1 3/2009 Hsu et al.
(Continued)

FOREIGN PATENT DOCUMENTS

CN 201246347 Y 5/2009
JP 2008-175099 A 7/2008

*Primary Examiner* — Patrick Hamo
(74) *Attorney, Agent, or Firm* — Keating & Bennett

(57) ABSTRACT

A serial axial flow fan includes a first axial flow fan, a second axial flow fan, and a current plate. Hollow cells of the current plate are partitioned by a lattice-shaped partition, penetrate in an axial direction, and are uniformly two-dimensionally arranged at an outer edge. An axially lower end portion of a first housing of the first axial flow fan and an axially upper end portion of a second housing are directly coupled to each other, and the current plate is provided in a coupling unit of the first housing and the second housing. An axially lower end portion of the first tubular unit of the first housing is axially opposed to an axially upper end portion of the second tubular unit of the second housing with the current plate interposed therebetween. A recess recessed on an opposite side to the coupling unit in the axial direction is provided on an axially end surface of at least one of an axially lower end surface of the first tubular unit and an axially upper end surface of the second tubular unit. A lead wire of at least one of the first axial flow fan and the second axial flow fan is accommodated in the recess. At least a portion of the recess overlaps a portion of the current plate in the axial direction.

15 Claims, 13 Drawing Sheets

(51) Int. Cl.
*F04D 29/64* (2006.01)
*F04D 29/52* (2006.01)
*F04D 29/66* (2006.01)

(52) U.S. Cl.
CPC ..... *F04D 29/522* (2013.01); *F04D 29/646* (2013.01); *F04D 29/667* (2013.01)

(56) References Cited

U.S. PATENT DOCUMENTS

| | | | | |
|---|---|---|---|---|
| 2009/0226299 | A1* | 9/2009 | Jin | F04D 19/007 415/66 |
| 2013/0051997 | A1 | 2/2013 | Uchiyama et al. | |
| 2018/0100518 | A1 | 4/2018 | Sun et al. | |
| 2018/0195526 | A1* | 7/2018 | Hakozaki | F04D 19/007 |
| 2019/0301472 | A1* | 10/2019 | Kato | F04D 19/007 |

* cited by examiner

SERIAL AXIAL FLOW FAN

CROSS REFERENCE TO RELATED APPLICATIONS

This application claims the benefit of priority to U.S. Patent Application No. 62/561,309 filed on Sep. 21, 2017, U.S. Patent Application No. 62/635,610 filed on Feb. 27, 2018 and Japanese Patent Application No. 2018-162256 filed on Aug. 31, 2018. The entire contents of these applications are hereby incorporated herein by reference.

BACKGROUND OF THE INVENTION

1. Field of the Invention

The present disclosure relates to a serial axial flow fan.

2. Description of the Related Art

A serial axial flow fan, in which two axial flow fans are connected in an axial direction to increase a blast volume, is conventionally known. In the serial axial flow fan, an air flow sent from a preceding-stage axial flow fan that sucks outside air of the serial axial flow fan is sucked by a subsequent-stage axial flow fan. The air flow in which a flow rate is increased by the preceding-stage axial flow fan is sent from the subsequent-stage axial flow fan to an outside of the serial axial flow fan. At this point, the air flow sent from the preceding-stage axial flow fan has the same turning component as a rotational direction of an impeller in addition to an axial component. However, the turning component of the air flow hardly flows in the axial direction by the subsequent-stage axial flow fan.

For example, in a unit type fan disclosed in Japanese Laid-open Patent Application Publication No. 2003-56498, by positioning a static blade fan frame structure between two heat-dissipating fans, interference between the two heat-dissipating fans to increase an air volume and wind pressure of the air flow generated during operation of the heat-dissipating fan.

Also, in Chinese Patent Application Publication No. 201246347, a fan casing is attached to an exhaust side of the axial flow fan. In the fan casing, a protrusion having a honeycomb structure is provided, and a plate-shaped frame screwed to the axial flow fan expands in the direction perpendicular to the axial direction from an outside surface of the protrusion. The protrusion having the honeycomb structure guides the air flow sent from the axial flow fan, thereby further concentrating the air flow.

In the coupling unit between the two axial flow fans, sometimes a recess recessed in the axial direction from the coupling unit is provided in a housing of the axial flow fan in order to extract a lead wire extending from the motor to the outside. In this case, a part of the air flow sent from the preceding-stage axial flow fan tends to flow to the outside of the serial axial flow fan through the recess. Thus, turbulence is easily generated near the recess. The generation of the turbulence affects blowing efficiency of the serial axial flow fan.

SUMMARY OF THE INVENTION

According to one aspect of a preferred embodiment of the present disclosure, a serial axial flow fan includes a first axial flow fan, a second axial flow fan connected in series with the first axial flow fan, and a current plate in which a plurality of hollow cells, which are partitioned by a lattice-shaped partition wall and penetrate in an axial direction, are uniformly two-dimensionally arranged at an outer edge. The first axial flow fan includes a first impeller including a first blade rotatable about a vertically extending center axis, a first motor that drives the first impeller to rotate the first blade, a first housing including a first tubular unit having an axially extending tubular shape, the first impeller and the first motor being accommodated in the first tubular unit, and a first lead wire extending from the first motor. The second axial flow fan includes a second impeller including a second blade rotatable about the center axis, a second motor that drives the second impeller to rotate the second blade, a second housing including a second tubular unit having an axially extending tubular shape, the second impeller and the second motor being accommodated in the second tubular unit, and a second lead wire extending from the second motor. An axially lower end portion of the first housing and the axially upper end portion of the second housing are directly coupled to each other. The current plate is provided at a coupling unit of the first housing and the second housing. An axially lower end portion of the first tubular unit is axially opposed to an axially upper end portion of the second tubular unit with the current plate interposed therebetween. A recess recessed in an opposite direction to the coupling unit in the axial direction is provided on an axial end surface of at least one of the axially lower end surface of the first tubular unit and the axially upper end surface of the second tubular unit. At least one of the first lead wire and the second lead wire is accommodated in the recess. At least a portion of the recess overlaps a portion of the current plate in the axial direction.

According to an exemplary serial axial flow fan of the present disclosure, the blowing efficiency of the serial axial flow fan is improved.

The above and other elements, features, steps, characteristics and advantages of the present disclosure will become more apparent from the following detailed description of the preferred embodiments with reference to the attached drawings.

DETAILED DESCRIPTION OF THE PREFERRED EMBODIMENTS

Hereinafter, exemplary embodiments of the present disclosure will be described with reference to the drawings.

In the specification, a direction parallel to a center axis CA in a serial axial flow fan 100 is referred to as an axial direction. In the axial direction, a direction from a second axial flow fan 2 (to be described later) to a first axial flow fan 1 (to be described later) is referred to as an axially upper side, and a direction from the first axial flow fan 1 to the second axial flow fan 2 is referred to as an axially lower side. In each component, an end portion on the axially upper side is referred to as an axially upper end portion, and a position of the axially upper end portion in the axial direction is referred to as an axially upper end. An end portion on the axially lower side is referred to as an axially lower end portion, and a position of the axially lower end portion in the axially direction is referred to as an axially lower end. In a surface of each component, a surface facing the axially upper side is referred to as an axially upper end surface, and a surface facing the axially lower side is referred to as an axially lower end surface. A generic name of the axially upper end surface and the axially lower end surface is called an axial end surface.

A direction orthogonal to the center axis CA is referred to as a radial direction, and a rotational direction about the center axis CA is referred to as a circumferential direction. In the radial direction, a direction toward the center axis CA is referred to as a radial inside, and a direction away from the center axis CA is referred to as a radial outside. In each component, an end portion of the radial inside is referred to as a radially inner end portion, and a position of the radial inside in the radial direction is referred to as a radially inner end. An end portion of the radial outside is referred to as a radially outer end portion, and a position of the radial outside in the radial direction is referred to as a radially outer end. In a side surface of each component, a side surface facing the radial inside is referred to as a radially inside surface, and a side surface facing the radial outside is referred to as a radially outside surface.

Names of the direction, the end portion, the position, and the surface do not express a positional relationship and the direction in the case that the serial axial flow fan is incorporated in an actual device.

Figure 1:
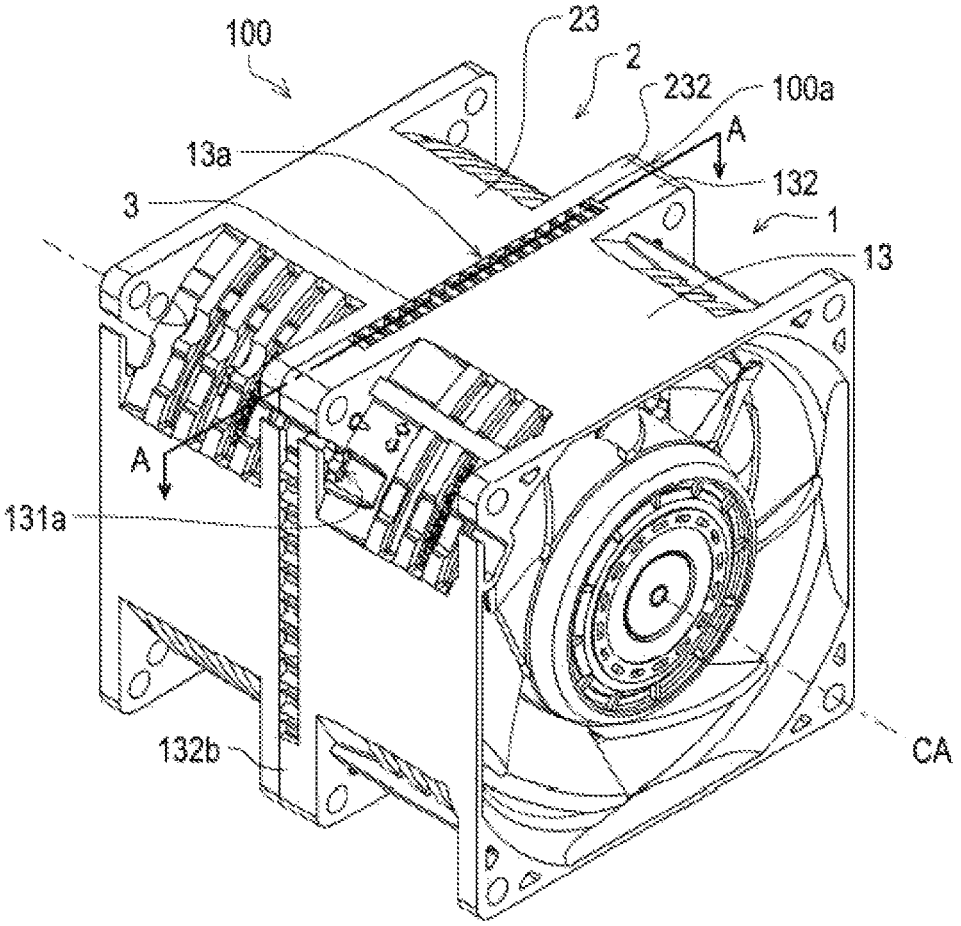
FIG. 1 is a perspective view illustrating an example of a serial axial flow fan according to a preferred embodiment of the present disclosure.
Figure 2:
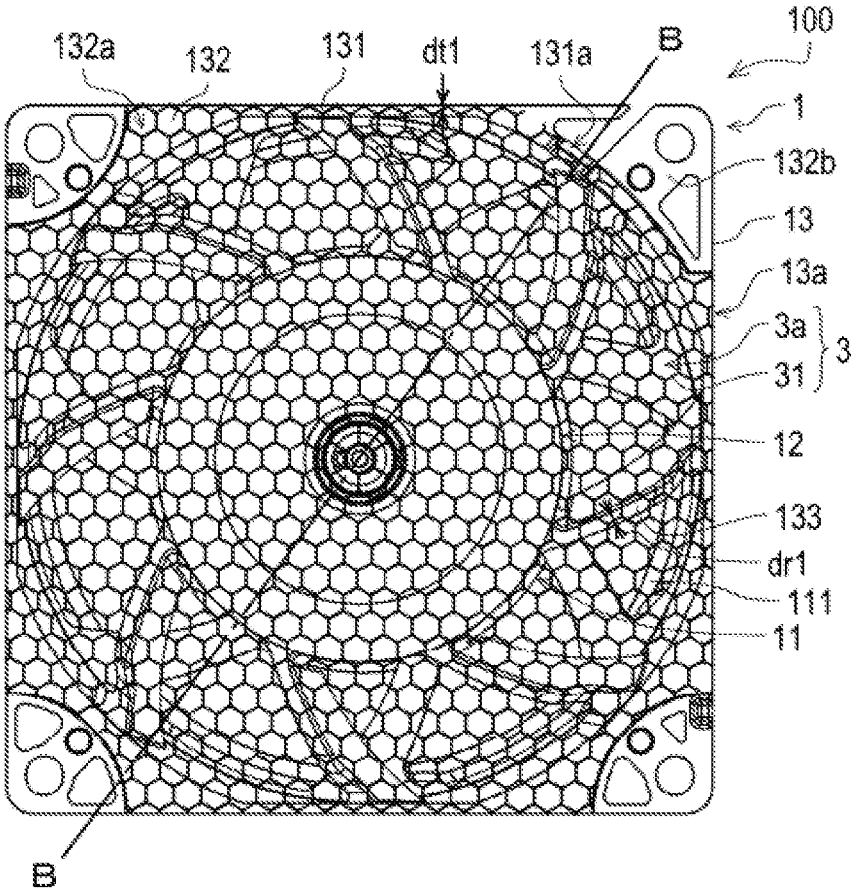
FIG. 2 is a sectional view of the serial axial flow fan taken along a one dot chain line A-A in FIG. 1.
Figure 3:
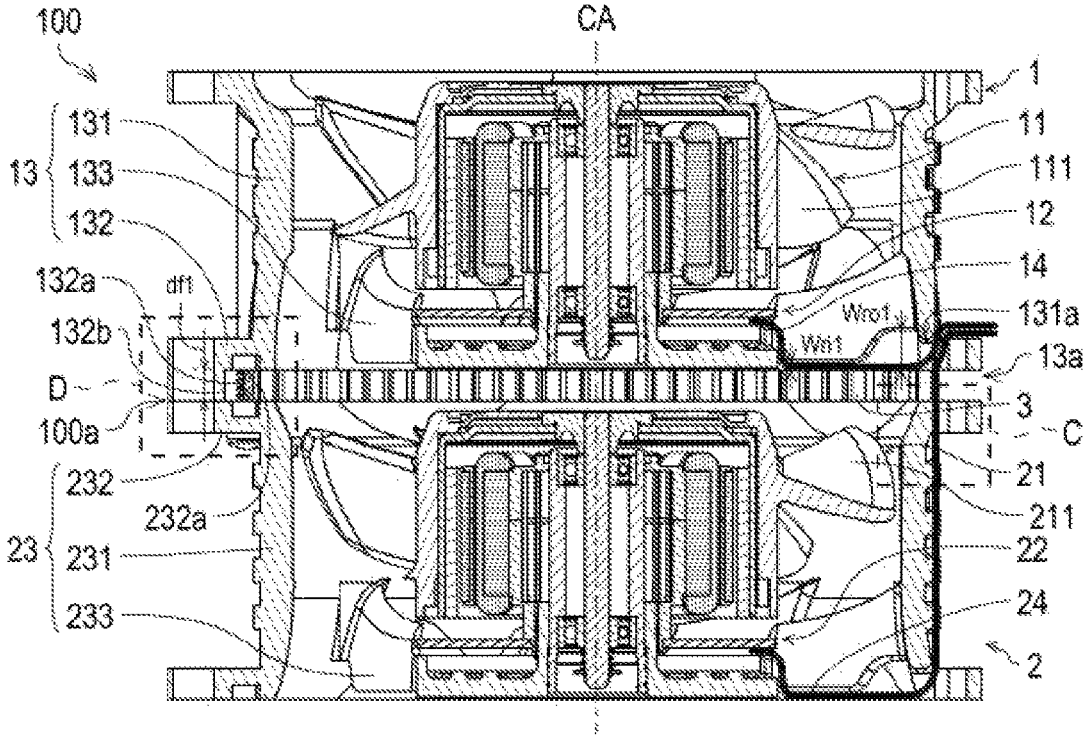
FIG. 3 is a sectional view of the serial axial flow fan taken along a one dot chain line B-B in FIG. 2.

FIG. 1 is a perspective view illustrating an example of the serial axial flow fan 100 according to an embodiment. FIG. 2 is a sectional view of the serial axial flow fan 100 taken along a one dot chain line A-A in FIG. 1. FIG. 3 is a sectional view of the serial axial flow fan 100 taken along a one dot chain line B-B in FIG. 2. FIG. 2 illustrates a sectional structure obtained by cutting the serial axial flow fan 100 at a virtual plane perpendicular to the axial direction. FIG. 3 illustrates a sectional structure obtained by cutting the serial axial flow fan 100 at a virtual plane including the center axis CA.

As illustrated in FIG. 1, the serial axial flow fan 100 includes the first axial flow fan 1, the second axial flow fan 2, and a current plate 3. The serial axial flow fan 100 is a blowing device in which the preceding-stage first axial flow fan 1 and the subsequent-stage second axial flow fan 2 are connected in series with the current plate 3 interposed therebetween.

As described above, the serial axial flow fan 100 includes the first axial flow fan 1. The first axial flow fan 1 includes a first impeller 11, a first motor 12, a first housing 13, and a first lead wire 14. The first housing 13 includes a first tubular unit 131, a first flange 132, and a first rib 133. As described above, the serial axial flow fan 100 also includes the second axial flow fan 2. The second axial flow fan 2 is connected in series with the first axial flow fan 1. The second axial flow fan 2 includes a second impeller 21, a second motor 22, a second housing 23, and a second lead wire 24. The second housing 23 includes a second tubular unit 231, a second flange 232, and a second rib 233.

Hereinafter, a generic name of the first housing 13 and the second housing 23 is referred to as housings 13, 23. The generic name of the first lead wire 14 and the second lead wire 24 is referred to as lead wires 14, 24. The generic name of the first tubular unit 131 and the second tubular unit 231 is referred to as tubular units 131, 231. The generic name of the first flange 132 and the second flange 232 is referred to as flanges 132, 232. The generic name of the first rib 133 and the second rib 233 is referred to as ribs 133, 233. Each component of the first axial flow fan 1 and the second axial flow fan 2 will be described later.

The current plate 3 is provided at a coupling unit 100*a* between the first housing 13 and the second housing 23. The current plate 3 provided in the coupling unit 100*a* between the first housing 13 and the second housing 23 rectifies the air flow sent downward in the axial direction from the first axial flow fan 1. The second axial flow fan 2 sucks the air flow rectified by the current plate 3. The rectified air flow has a small turning component, and flows easily in the axial direction by the second axial flow fan 2. Consequently, pressure and an air volume of the air flow sent from the second axial flow fan 2 increase. As a result, an amount of air sucked or sent by the serial axial flow fan 100 can be increased. Thus, the blowing efficiency of the serial axial flow fan 100 can further be improved. Although the current plate 3 is made of aluminum in the embodiment, the current plate 3 may be made of another metal material or a ceramic material. A detailed configuration of the current plate 3 will be described later.

Next, each constituent element of the first axial flow fan 1 will be described below with reference to FIGS. 1 to 3.

As described above, the first axial flow fan 1 has the first impeller 11. The first impeller 11 has a first blade 111. The first blade 111 is rotatable about the vertically extending center axis CA. The first motor 12 drives the first impeller 11 to rotate the first blade 111 about the center axis CA. Consequently, the first axial flow fan 1 sucks air from the axially upper side of the serial axial flow fan 100 at the axially upper end portion of the first axial flow fan 1. The first axial flow fan 1 generates the air flow flowing to the axially lower side, and sends the air flow from the axially lower end portion of the first axial flow fan 1.

As described above, the first axial flow fan 1 includes the first motor 12. The first motor 12 drives the first impeller 11 to rotate the first blade 111. The axially lower end portion of the first motor 12 may be in contact with the axially upper end surface of the current plate 3. Alternatively, the axially lower end portion of the first motor 12 may be opposed to the axially upper end surface of the current plate 3 in the axial direction with a gap interposed therebetween.

As described above, the first axial flow fan 1 includes the first housing 13. As described above, the first housing 13 has the first tubular unit 131. The first tubular unit 131 has a tubular shape extending in the axial direction, and accommodates the first impeller 11 and the first motor 12 therein. The axially lower end portion of the first tubular unit 131 is opposed to the axially upper end portion of the second tubular unit 231 with the current plate 3 interposed therebetween. In the embodiment, the axially lower end portion of the first tubular unit 131 abuts on the axially upper end surface of the current plate 3. Consequently, the air flow can be prevented from flowing in the radial direction in the axially lower end portion of the first tubular unit 131. Thus, the generation of turbulence can be prevented in the axially lower end portion of the first tubular unit 131. However, the present invention is not limited to this example, but a gap may exist between the first tubular unit 131 and the current plate 3 in the axial direction.

In the embodiment, a first recess 131*a* recessed on the opposite side to the coupling unit 100*a* in the axial direction is provided on the axially lower end surface of the first tubular unit 131. The first recess 131*a* is recessed in the axially upper side on the axially lower end surface of the first tubular unit 131, and penetrates the first tubular unit 131 in the radial direction.

As described above, the first housing 13 further includes the first flange 132. The first flange 132 expands to the radial outside from the axial end portion of the first tubular unit 131 on the side of the coupling unit 100*a*. In other words, the first flange 132 expands from the axially lower end portion of the first tubular unit 131 to the radial outside. A first planar unit 132*a* and a first leg 132*b* are provided on the axially lower end surface of the first flange 132. The first planar unit 132*a* abuts on the axially upper end surface of the current plate 3. The first leg 132*b* protrudes axially downward of the first flange 132. A plurality of the first legs 132*b* are provided in the circumferential direction. The axially lower end portion of the first leg 132*b* abuts on the second flange 232. Consequently, in the axial direction, a space in which the current plate 3 is accommodated is provided between the first tubular unit 131 and the second tubular unit 231. An axial length df1 of the first leg 132*b* in FIG. 3 is less than or equal to an axial length dc of the current plate 3 in FIGS. 7 and 7A (to be described later). The axial length df1 of the first leg 132*b* is the axial width between the first planar unit 132*a* and the axially lower end portion of the first leg 132*b*. For this reason, in the axial direction, the current plate 3 is sandwiched and held between the axially lower end portion of the first tubular unit 131 and the axially upper end portion of the second tubular unit 231. When viewed from the axial direction, the first leg 132*b* is provided in the radial outside of the first recessed 131*a*.

As described above, the first housing 13 further includes the first rib 133. A radially inner end portion of the first rib 133 supports the first motor 12. The radially outer end portion of the first rib 133 is connected to the first tubular unit 131.

The first rib 133 is opposed to the axially upper end surface of the current plate 3 in the axial direction with a gap interposed therebetween. A minimum axial width (Wri1 in FIG. 3) of the gap is narrower than a width (for example, a width Wc in FIGS. 7 and 7A) in the direction perpendicular to the axial direction of a hollow cell 3*a* of the current plate 3. Consequently, the gap between the first rib 133 and the current plate 3 is provided narrower than the width in the direction perpendicular to the axial direction of the hollow cell 3*a*, which allows a decrease in the amount of air flow to be prevented in the hollow cell 3*a* overlapping the first rib 133 in the axial direction while the rectification effect of the first rib 133 is maintained. This is because the amount of air flow passing through the hollow cell 3*a* overlapping the first rib 133 in the axial direction decreases in the case that the gap does not exist between the first rib 133 and the current plate 3 in the axial direction. On the other hand, the effect of rectifying the air flow flowing in the axial direction by the first rib 133 is degraded in the case that the axial width of the gap between the first rib 133 and the current plate 3 is excessively wide.

The axial width Wri1 of the gap on the radial inside between the first rib 133 and the axially upper end surface of the current plate 3 is smaller than an axial width Wro1 of the gap on the radial outside between the first rib 133 and the axially upper end surface of the current plate 3. In the embodiment, as illustrated in FIG. 3, the axial width Wri1 is smaller than the width Wc between two sides of the hexagonal hollow cell 3*a* of the current plate 3. On the other hand, the axial width Wro1 is larger than the width Wc between the two sides of the hexagonal hollow cell 3*a*. The radial inside and the radial outside of the first rib 133 are different from each other in an optimum value of the axial width of the gap, which improves the pressure and the air volume of the air and prevents the generation of the turbulence. In particular, the optimum value is influenced by the radially inside surface of the first tubular unit 131 in the radially outer end portion of the first rib 133. For this reason, the axial width Wro1 of the gap is increased larger than the width Wc between the two sides of the hollow cell 3*a*, which allows the improvement of a pressure-air volume characteristic of the serial axial flow fan 100.

A width dr1 of a region of the first rib 133 opposed to the current plate 3 in the axial direction is preferably less than or equal to the width Wc between the two sides of the hexagonal hollow cell 3*a*. For example, the region is the axially lower end portion of the first rib 133. For example, the width dr1 is the minimum width in the direction perpendicular to the axial direction of the first rib 133. Consequently, the pressure and the air volume of the air flow flowing from the first axial flow fan 1 to the second axial flow fan 2 in the current plate 3 can be improved, and the generation of turbulence can be prevented.

In the embodiment, four first openings 13*a* are provided in the first housing 13 as illustrated in FIG. 3. The first opening 13*a* is provided in the axially lower end portion of the first housing 13, and recessed toward the axially upper side. The first opening 13*a* penetrates the first housing 13 in the radial direction, and particularly penetrates a part of the first tubular unit 131 and a part of the first flange 132 in the radial direction. In the first opening 13*a*, the radially outer end surface of the current plate 3 is exposed to the outside of the serial axial flow fan 100. The radially outer end portion of the current plate 3 is located at the same position as the first opening 13*a* as illustrated in FIG. 2 or on the radial inside of the first opening 13*a*.

Figure 4A:
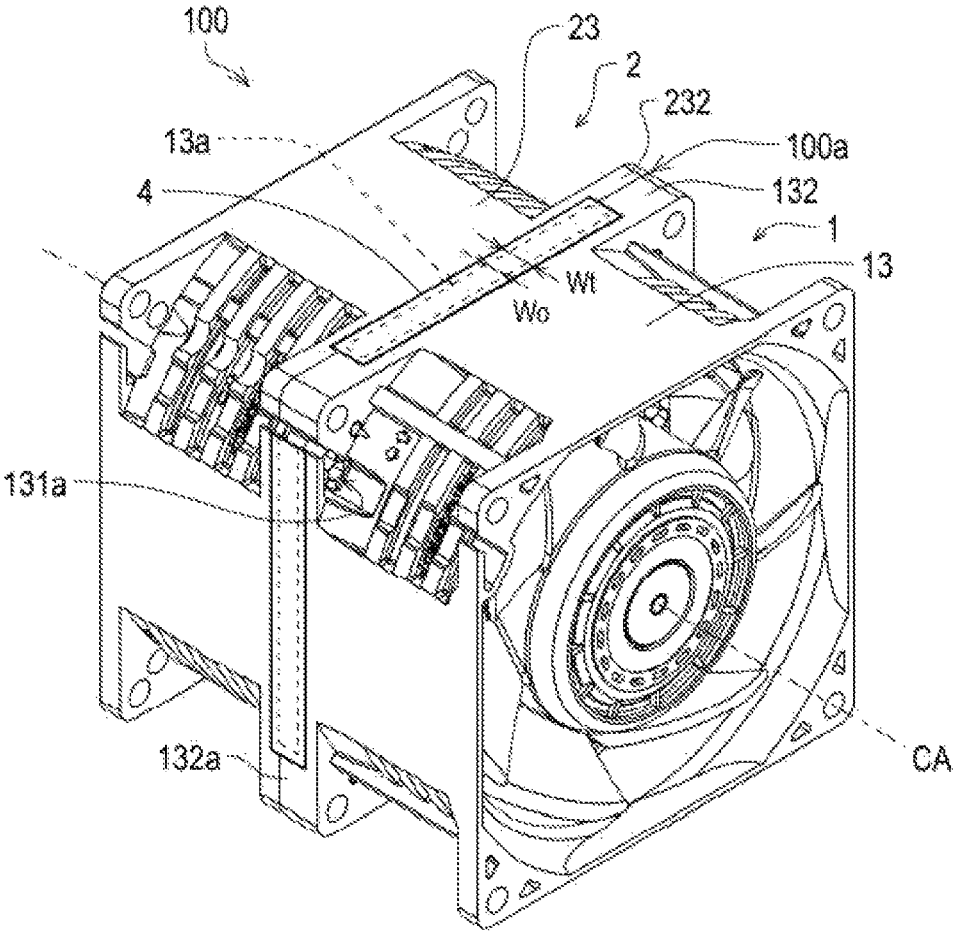
FIG. 4A is a perspective view illustrating a first example of a belt-shaped member covering a first opening.
Figure 4B:
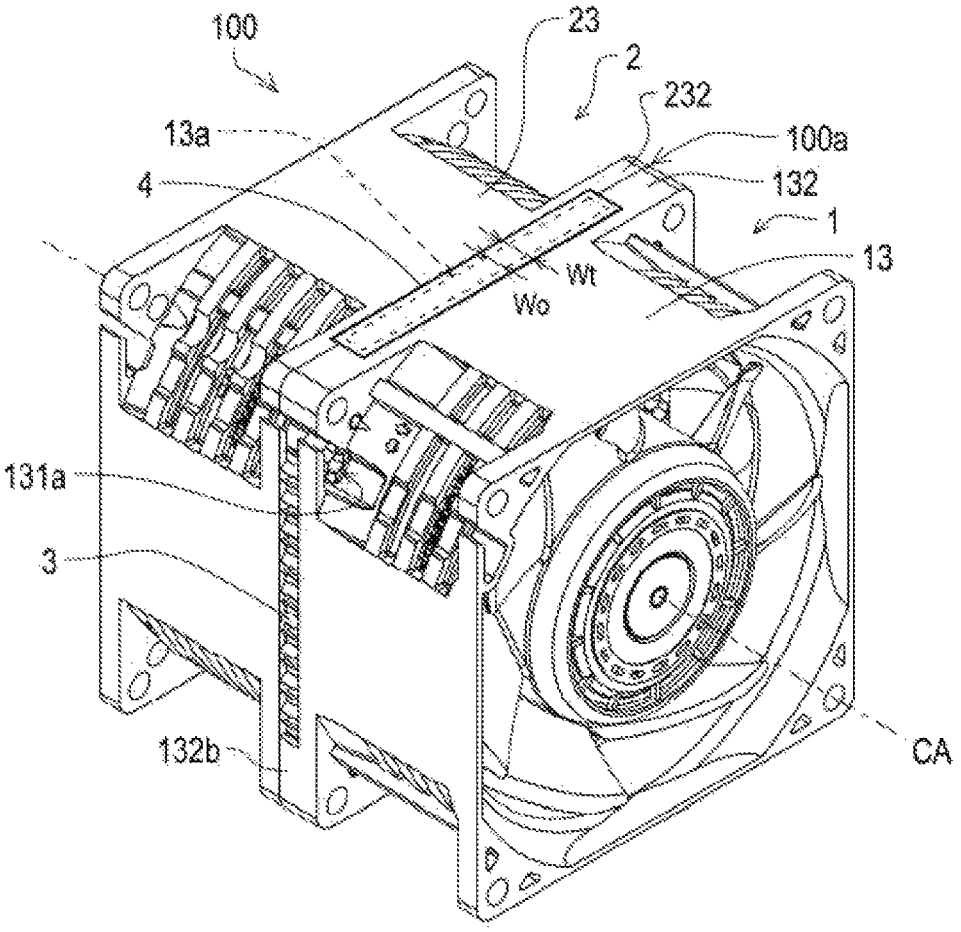
FIG. 4B is a perspective view illustrating a second example of the belt-shaped member covering the first opening.
Figure 4C:
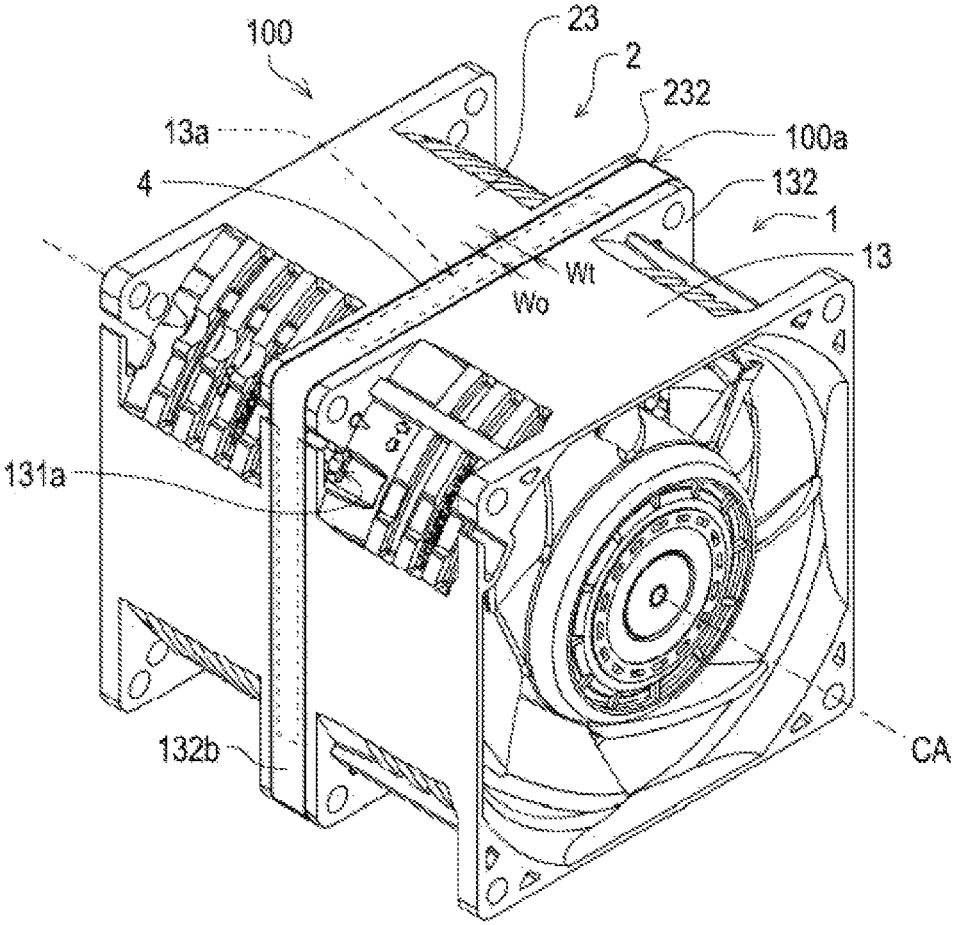
FIG. 4C is a perspective view illustrating a third example of the belt-shaped member covering the first opening.

The present invention is not limited to the example in FIG. 1, but the current plate 3 may not be exposed at the first opening 13*a*. For example, the serial axial flow fan 100 may further include a belt-shaped member 4 provided on the radially outside surface of the coupling unit 100*a*. In other words, the belt-shaped member 4 may cover the first opening 13*a*. FIGS. 4A to 4C are perspective views illustrating first to third examples of the belt-shaped member 4 covering the first opening 13*a*, respectively.

For example, as illustrated in FIG. 4A, all the first openings 13*a* may be covered with the belt-shaped member 4. Consequently, leakage of air at all the first openings 13*a* of the coupling unit 100*a* can be reduced or prevented by the belt-shaped member 4 provided in each first opening 13*a*.

Alternatively, as illustrated in FIG. 4B, a part of the first openings 13*a* may be covered with the belt-shaped member 4. Consequently, only a part of the plurality of first openings 13*a* is covered with the belt-shaped member 4, so that the belt-shaped member 4 can be saved.

In FIGS. 4A and 4B, the belt-shaped member 4 is provided in each first opening 13*a*. Alternatively, the belt-shaped member 4 may be provided as a single unit as illustrated in FIG. 4C. That is, the belt-shaped member 4 may be wound around the entire circumference in the circumferential direction on radially outside surface of the coupling unit 100*a*. Consequently, work to provide the belt-shaped member 4 is facilitated.

As described above, the first axial flow fan 1 includes the first lead wire 14. The first lead wire 14 extends from the first motor 12. In the embodiment, the first lead wire 14 is accommodated in the first recess 131*a*. More specifically, the first lead wire 14 is inserted in the first recess 131*a*, and extracted to the outside of the first housing 13 through the first recess 131*a*.

Next, each component of the second axial flow fan 2 will be described below with reference to FIGS. 1 and 3.

As described above, the second axial flow fan 2 includes the second impeller 21. The second impeller 21 includes a second blade 211. The second blade 211 is rotatable about the vertically extending center axis CA. The second motor 22 drives the second impeller 21 to rotate the second blade 211 about the center axis CA. Consequently, the second axial flow fan 2 sucks the air flow sent from the first axial flow fan 1 in the axially upper end portion of the second axial flow fan 2 through the current plate 3. The second axial flow fan 2 accelerates the flow speed of the air flow flowing to the axially lower side, and sends the air flow from the axially lower end portion of the second axial flow fan 2 to the axially lower side of the serial axial flow fan 100.

As described above, the second axial flow fan 2 includes the second motor section 22. The second motor 22 drives the second impeller 21 to rotate the second blade 211.

As described above, the second axial flow fan 2 includes the second housing 23. As described above, the second housing 23 includes the second tubular unit 231. The second tubular unit 231 has a tubular shape extending in the axial direction, and accommodates the second impeller 21 and the second motor 22 therein. In the embodiment, the axially upper end portion of the second tubular unit 231 abuts on the axially lower end surface of the current plate 3. Consequently, the air flow can be prevented from flowing in the radial direction in the axially upper end portion of the second tubular unit 231. Thus, the generation of turbulence can be prevented in the axially upper end portion of the second tubular unit 231. However, the present invention is not limited to this example, but a gap may exist between the second tubular unit 231 and the current plate 3 in the axial direction.

As described above, the second housing 23 further includes the second flange 232. The second flange 232 expands to the radial outside from the axial end portion of the second tubular unit 231 on the side of the coupling unit 100*a*. In other words, the second flange 232 expands from the axially upper end portion of the second tubular unit 231 to the radial outside. The second flange 232 is connected to the first flange 132. This enables the axially lower end portion of the first housing 13 and the axially upper end portion of the second housing 23 to be directly connected to each other. Consequently, an equivalent to that in the configuration in which the current plate 3 is not provided in the coupling unit 100*a* between the first housing 13 and the second housing 23 can be secured.

A second planar unit 232*a* is provided on the axial upper end surface of the second flange 232. The second planar unit 232*a* is in contact with the axially lower end surface of the current plate 3. Hereinafter, the generic name of the first planar unit 132*a* and the second planar unit 232*a* is referred to as planar units 132*a*, 232*a*. As described above, in the present disclosure, the planar units 132*a*, 232*a* abutting on the axial end face of the current plate 3 are provided in the first flange 132 and the second flange 232. This enables the current plate 3 provided between the first tubular unit 131 and the second tubular unit 231 to be sandwiched between the first planar unit 132*a* and the second planar unit 232*a*. Thus, the current plate 3 can be held more reliably in the axial direction. However, the present invention is not limited to this example, but a gap may exist between at least one of the first flange 132 and the second flange 232 and the current plate 3 in the axial direction. A vibration of the current plate 3 and generation of a noise caused by the vibration can be prevented by providing the gap.

As described above, the second housing 23 further includes the second rib 233. The radially inner end portion of the second rib 233 supports the second motor 22. The radially outer end portion of the second rib 233 is connected to the second tubular unit 231.

As described above, the second axial flow fan 2 includes the second lead wire 24. The second lead wire 24 extends from the second motor 22.

Figure 5:
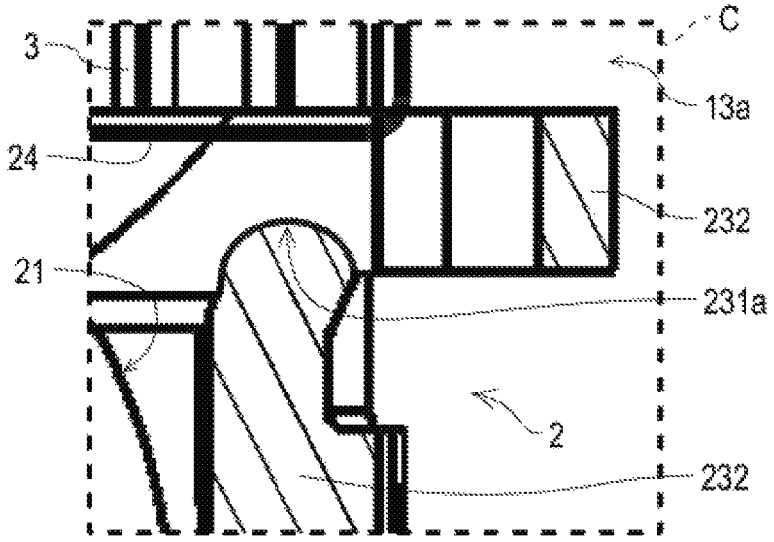
FIG. 5 is a sectional view illustrating an example of a second recess provided in a second tubular unit.

In the above embodiment, as illustrated in FIG. 3, the first recess 131*a* used to extract the first lead wire 14 to the outside of the first housing 13 is provided in the first tubular unit 131. Similarly, as illustrated in FIG. 5, a second recess 231*a* used to extract the second lead wire 24 to the outside of the second housing 23 may be provided in the second tubular unit 231. FIG. 5 illustrates an example of the second recess 231*a* provided in the second tubular unit 231. FIG. 5 corresponds to a portion C surrounded by a broken line in FIG. 3. In FIG. 5, the second recess 231*a* recessed on the opposite side to the coupling unit 100*a* in the axial direction is provided on the axially upper end surface of the second tubular unit 231. The second recess 231*a* is recessed in the axially lower side on the axially upper end surface of the second tubular unit 231, and penetrates the second tubular unit 231 in the radial direction. Both the first recess 131*a* and the second recess 231*a* may be provided in the serial axial flow fan 100, or the second recess 231*a* may be provided instead of the first recess 131*a*. Hereinafter, the generic name of the first recess 131*a* and the second recess 231*a* is referred to as recesses 131*a*, 231*a*. As described above, in the present disclosure, the recesses 131*a*, 231*a* recessed on the opposite side to the coupling unit 100*a* in the axial direction are provided on the axial end surface of at least one of the housings 12, 23 in the axially lower end surface of the first tubular unit 131 and the axially upper end surface of the second tubular unit 231.

The first lead wire 14 is extracted to the outside of the first housing 13 through the first recess 131*a* in FIG. 3, and the second lead wire 24 is extracted to the outside of the second housing 23 through the second recess 231*a* in FIG. 5. However, the present invention is not limited to these examples, but both the first lead wire 14 and the second lead wire 24 may be extracted to the outside of the housings 13, 23 through the first recess 131*a* or the second recess 231*a*. That is, in the present disclosure, at least one of the first lead wire 14 and the second lead wire 24 is accommodated in the recesses 131*a*, 231*a*.

In the present disclosure, at least a part of the recesses 131*a*, 231*a* provided on at least one of the axially lower end surface of the first tubular unit 131 and the axially upper end surface of the second tubular unit 231 preferably overlaps a part of the current plate 3 in the axial direction. Consequently, even if at least one of the lead wires 14, 24 accommodated in the recesses 131*a*, 231*a* is deflected, movement of the deflected lead wires 14, 24 toward the coupling unit 100*a* in the axial direction can be further prevented by the current plate 3. Disturbance of the air flow due to the recesses 131*a*, 231*a* can be further prevented by the current plate 3. Thus, the pressure-air volume characteristic of the serial axial flow fan 100 can be improved, and the blowing efficiency of the serial axial flow fan 100 can further be improved. The noise generated by the serial axial flow fan 100 can be reduced.

In the present disclosure, when viewed in the axial direction, the radially outer end of the current plate 3 is preferably located at the same position as the radially outer ends of the recesses 131*a*, 231*a*, or on the radial inside of the radially outer ends of the recesses 131*a*, 231*a*. Consequently, when viewed in the axial direction, the radial outside of the current plate 3 is not located on the radial outside of the radially outer ends of the recesses 131*a*, 231*a*. For this reason, the radially outer end portion of the current plate 3 does not become an obstacle even in the case that the second lead wire 24 extends in the axial direction to the radially outer end portion of the first recess 131*a* along the radially outer surface of the second tubular unit 231 as illustrated in FIG. 3. Thus, a layout of the second lead wires 24 can be more freely designed. At this point, the radially outer end portion of the current plate 3 is not pushed onto the radial inside by the second lead wire 24, so that deformation of the radially outer end portion of the current plate 3 can be prevented.

Figure 6:
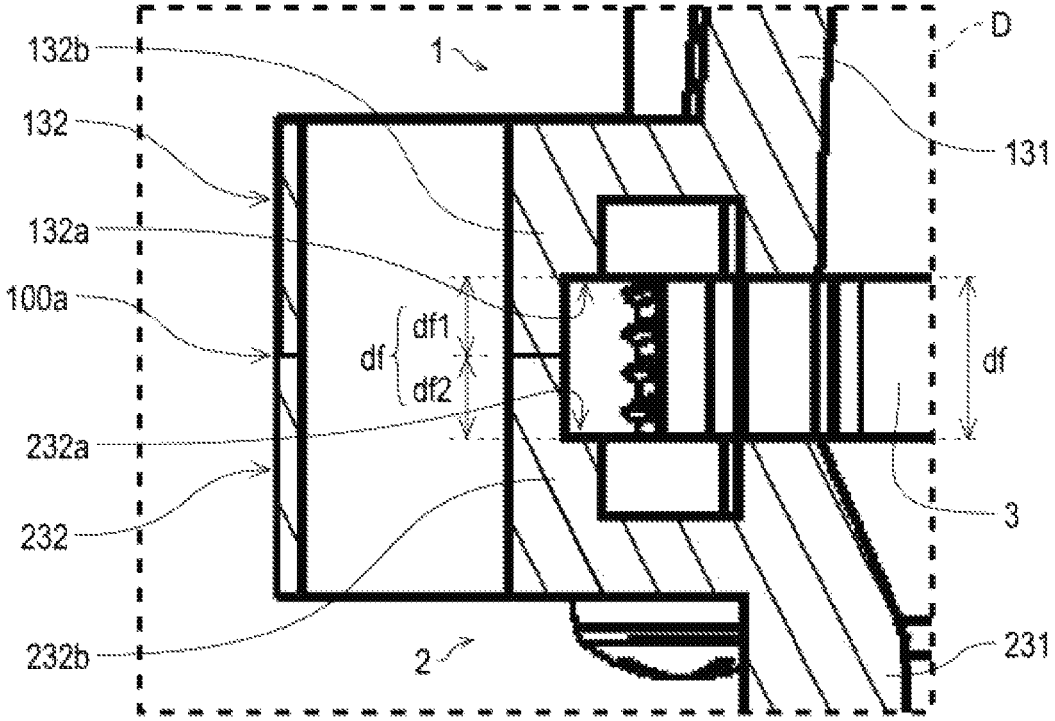
FIG. 6 is a sectional view illustrating an example of a second leg provided in the second tubular unit.

In the above embodiment, for example, as illustrated in FIG. 3, the first leg 132*b* is provided in the first flange 132. Similarly, as illustrated in FIG. 6, a second leg 232*b* protruding axially upward may be provided in the second flange 232. FIG. 6 is a sectional view illustrating an example of the second leg 232*b* provided in the second tubular unit 231. FIG. 6 corresponds to a portion D surrounded by a broken line in FIG. 3. Instead of the first leg 132*b*, a second leg 232*b* may be provided in the serial axial flow fan 100. Alternatively, both the first leg 132*b* and the second leg 232*b* may be provided as illustrated in FIG. 6. The axially upper end portion of the second leg portion 232*b* may abut on the first flange 132, or abut on the first leg 132*b* as illustrated in FIG. 6. Hereinafter, the generic name of the first leg 132*b* and the second leg 232*b* is referred to as legs 132*b*, 232*b*.

As described above, in the present disclosure, the legs 132*b*, 232*b* protruding in the axial direction are provided in the axial end surface of at least one of the first flange 132 and the second flange 232 on the side of the coupling unit 100*a*. The legs 132*b*, 232*b* provided on one of the flanges 132, 232 abut on the other of the flanges 132, 232 or the legs 132*b*, 232*b* provided in the other of the flanges 132, 232. Consequently, in the axial direction, a space having the same axial length as the legs 132*b*, 232*b* can be provided between the first tubular unit 131 and the second tubular unit 231. Thus, by coupling the first flange 132 and the second flange 232, the first housing 13 and the second housing 23 can directly be coupled to each other, and the current plate 3 can be accommodated in the space between the first tubular unit 131 and the second tubular unit 231 in the axial direction.

In FIG. 6, the second leg 232*b* is provided on the radial outside of the second recess 231*a*. As described above, in the present disclosure, the legs 132*b*, 232*b* are provided on the radial outside of the recesses 131*a*, 231*a* when viewed in the axial direction. Consequently, the legs 132*b*, 232*b* do not overlap the recesses 131*a*, 231*a* in the axial direction. For this reason, the lead wires 14, 24 are easily accommodated in the recesses 131*a*, 231*a*, and the current plate 3 and the recesses 131*a*, 231*a* are easily overlapped with each other in the axial direction. In the portion in which the current plate 3 overlaps the recesses 131*a*, 231*a*, the air flow can flow smoothly in the axial direction without being affected by the legs 132*b*, 232*b*. In molding the housings 13, 23 including the legs 132*b*, 232*b* in the flanges 132, 232 using a metal mold, the metal mold can vertically be opened. Thus, a metal mold structure can be simplified, and a process of molding the housings 13, 23 using the metal mold can easily be performed.

Figures 7, 7A:
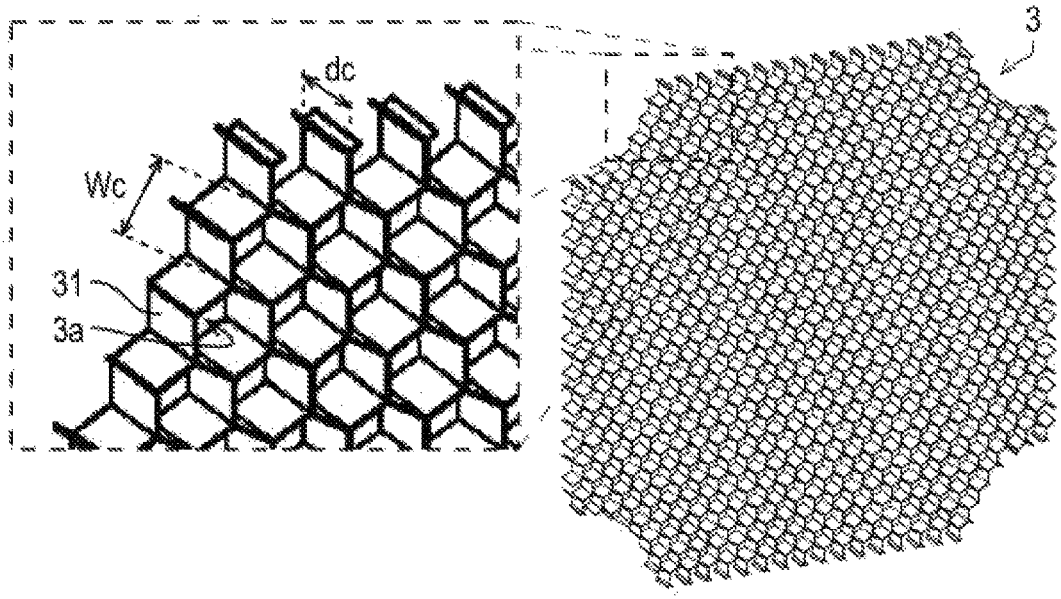
FIG. 7 is a perspective view illustrating an example of a current plate.
FIG. 7A is a partially enlarged view of FIG. 7.

An axial length df2 of the second leg 232*b* in FIG. 6 is less than or equal to the axial length dc of the current plate 3 in FIGS. 7 and 7A. The axial length df2 of the second leg 232*b* is the axial width between the second planar unit 232*a* and the axially upper end portion of the second leg 232*b*. Hereinafter, the generic name of the axial length df1 of the first leg 132*b* and the axial length df2 of the second leg 232*b* is referred to as an axial length df. As described above, in the present disclosure, the axial length df of the legs 132*b*, 232*b* is less than or equal to the axial length dc of the current plate 3. The axial length df of the legs 132*b*, 232*b* is the axial width between the planar units 132*a*, 232*a* of the flanges 132, 232 in which the legs 132*b*, 232*b* are provided and the axial end portions of the legs 132*b*, 232*b* on the side of the coupling unit 100*a*. Consequently, in the axial direction, the current plate 3 can be sandwiched and held between the axially lower end portion of the first tubular unit 131 and the axially upper end portion of the second tubular unit 231.

The plurality of second legs 232*b* are provided in the circumferential direction. That is, pluralities of the legs 132*b*, 232*b* are provided in the circumferential direction.

Next, a configuration of the current plate 3 will be described below with reference to FIGS. 7 and 7A. FIG. 7 is a perspective view illustrating an example of the current plate 3, and FIG. 7A is a partially enlarged view of FIG. 7.

As described above, the serial axial flow fan 100 is provided with the current plate 3. The current plate 3 includes a plurality of hollow cells 3*a* and a lattice-shaped partition wall 31. The hollow cells 3*a* of the current plate 3 are partitioned by the partition wall 31, and penetrate in the axial direction. The plurality of hollow cells 3*a* are arranged two-dimensionally uniformly from a central portion to an outer edge of the current plate 3. According to this structure, a frame and the like are not provided at outer edge of the current plate 3. For this reason, the effect of rectifying the air flow by the hollow cell 3*a* can be obtained up to the outer edge. The current plate 3 can be produced with no use of the metal mold. In other words, the plurality of hollow cells 3*a* have a structure partitioned by the lattice-shaped partition walls 31, and penetrate the current plate 3 in the axial direction. For this reason, the current plate 3 can secure the flow path of air in the axial direction at the maximum.

In the embodiment, the current plate 3 has a honeycomb structure in which hexagonal hollow cells 3*a* are two-dimensionally arranged when viewed in the axial direction. By adopting the honeycomb structure for the current plate 3, the effect of rectifying the air flow sent from the first axial flow fan can be improved to reduce air resistance during the rectification. Thus, the pressure-air volume characteristics of the serial axial flow fan can be enhanced. However, the present invention is not limited to this example, but the shape of the hollow cell 3*a* seen in the axial direction may be a polygonal shape other than the hexagonal shape, or a circular shape.

An opening ratio of the hollow cell 3*a* of the current plate 3 having the honeycomb structure is greater than or equal to 90%. As used herein, the opening ratio is a ratio of a sum of opening areas of all the hollow cells 3*a* in which a whole circumference is partitioned by the partition walls 31 to a total area of the axial end surface of the current plate 3. The current plate formed by resin molding hardly has the opening ratio of 90% or more. In the current plate 3 having the honeycomb structure, by setting the opening ratio to 90% or more, the higher rectification effect and the lower air resistance can be achieved as compared with current plates of other structures formed by resin molding.

The width Wc in FIG. 3 between the two sides of the hexagonal hollow cell 3*a* is larger than the radial width of the axial end portion of the first tubular unit 131 and the second tubular unit 231 on the side of the coupling unit 100*a*, the two sides of the hexagonal hollow cell 3*a* being opposed to each other and extending in parallel to each other. That is, the width Wc is larger than the radial width dt in FIGS. 7 and 7A of the axially lower end portion of the first tubular unit 131 and the radial width of the axially upper end portion of the second tubular unit 231. Consequently, in the hollow cell 3*a* overlapping the axial end portions of the first tubular unit 131 and the second tubular unit 231 on the side of the coupling unit 100*a* when seen in the axial direction, the axial end portions do not cover the whole hollow cells 3*a*. For this reason, when viewed in the axial direction, the air flow flowing in the vicinity of the inner walls of the first tubular unit 131 and the second tubular unit 231 in the hollow cells 3*a* overlapping the axial end portions of the first tubular unit 131 and the second tubular unit 231 on the side of the coupling unit 100*a*. Thus, the generation of the turbulence can be prevented in the vicinity of the inner walls in the axial end portions of the first tubular unit 131 and the second tubular unit 231.

Next, modifications of the embodiment will be described below. A configuration different from that of the above embodiment will be described below. The component similar to that of the above embodiment is denoted by the same reference numeral, and the description may be omitted.

In the above embodiment, the second rib 233 is provided in the axial lower portion of the second axial flow fan 2 (see FIG. 3). However, the present invention is not limited to the embodiment, and the second rib 233 may be provided in the upper axial upper portion of the second axial flow fan 2.

Figure 8:
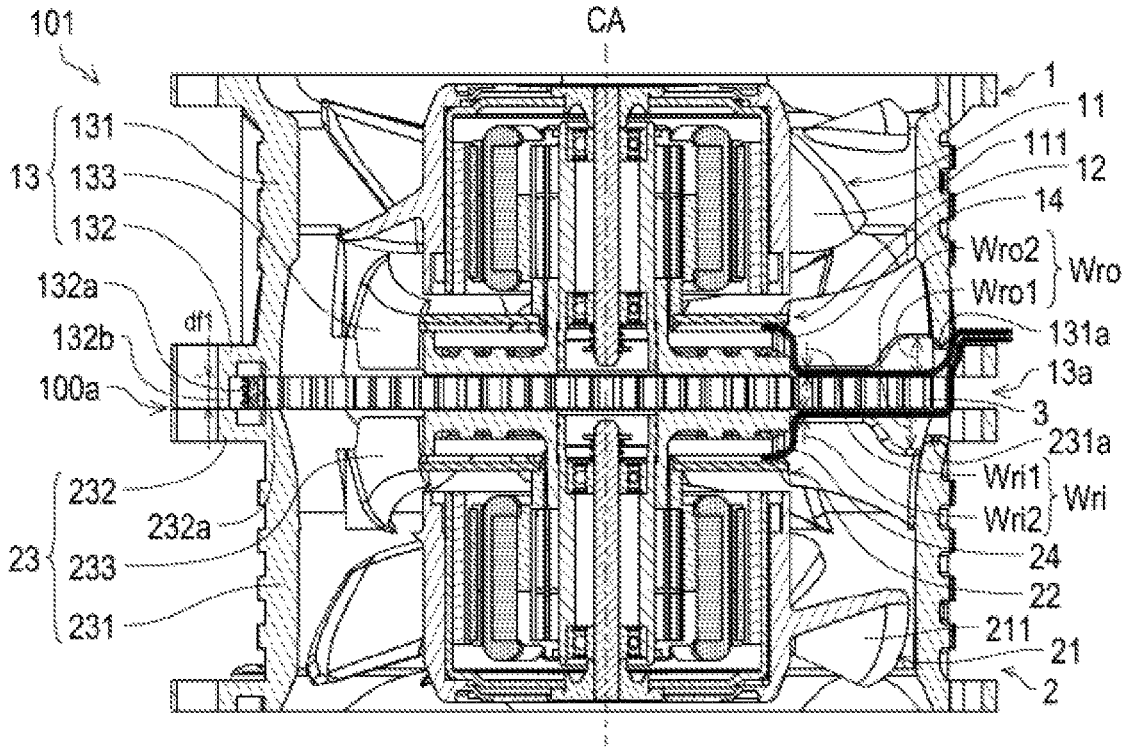
FIG. 8 is a sectional view of a serial axial flow fan according to a first modification of a preferred embodiment of the present disclosure.

FIG. 8 is a sectional view of a serial axial flow fan 101 according to a first modification. FIG. 8 illustrates a sectional structure obtained by cutting the serial axial flow fan 101 at a virtual plane including the center axis CA. In FIG. 8, the disposition of each component of the first axial flow fan 1 and the current plate 3 are identical to that in FIG. 3. However, the disposition of each component of the second axial flow fan 2 is vertically inverse to that in FIG. 3.

In the first modification, the second rib 233 is axially opposed to the axially lower end surface of the current plate 3 with a gap interposed therebetween. A minimum axial width (Wri2 in FIG. 8) of the gap is preferably narrower than the width (for example, a width Wc in FIGS. 7 and 7A) in the direction perpendicular to the axial direction of the hollow cell 3*a* of the current plate 3. Consequently, by providing the gap narrower than the width in the direction perpendicular to the axial direction of the hollow cell 3*a* between the second rib 233 and the current plate 3, a decrease in the amount of air flow can be prevented in the hollow cell 3*a* overlapping the second rib 233 in the axial direction while the rectification effect of the second rib 233 is maintained.

Thus, according to the embodiment and the first modification, at least one of the first rib 133 and the second rib 233 is axially opposed with the current plate 3 interposed therebetween. The minimum axial width of the gap between the second rib 233 and the current plate 3 is preferably narrower than the width Wc between the two sides of the hexagonal hollow cell 3*a* of the current plate 3 having the honeycomb structure. Consequently, the gap between at least one of the ribs 133, 233 and the current plate 3 is provided narrower than the width Wc in the direction perpendicular to the axial direction of the hollow cell 3*a*, which allows the decrease in the amount of air flow to be prevented in the hollow cell 3*a* overlapping at least one of the ribs 133 and 233 in the axial direction while the rectification effect of at least one of the ribs 133, 233 is maintained. The reason is that the large difference in the sizes of the openings on the inlet side and the outlet side of the hollow cell 3*a* cause the turbulence to degrade the effect of the current plate 3 in the case that the gap does not exist between at least one of the ribs 133, 233 and the current plate 3 in the axial direction. The reason is also that the effect that rectifies the air flow flowing in the axial direction by at least one of the ribs 133, 233 is degraded in the case that the axial width of the gap between at least one of the ribs 133, 233 and the current plate 3 is excessively wide.

The axial width Wri2 of the gap between the second rib 233 and the axially lower end surface of the current plate 3 on the radial inside is preferably smaller than the axial width Wro2 of the gap between the second rib 233 and the axially lower end surface of the current plate 3 on the radial outside. Hereinafter, the generic name of the axial width Wri1 of the gap between the first rib 133 and the current plate 3 on the radial inside and the axial width Wri2 of the gap between the second rib 233 and the current plate 3 on the radial inside is referred to as an axial width Wri. The generic name of the axial width Wro1 of the gap between the first rib 133 and the current plate 3 on the radial outside and the axial width Wro2 of the gap between the second rib 233 and the current plate 3 on the radial outside is referred to as an axial width Wro.

In the embodiment, as illustrated in FIGS. 7 and 7A, the axial width Wri2 is smaller than the width Wc between two sides of the hexagonal hollow cell 3*a* of the current plate 3. On the other hand, the axial width Wro is larger than the width Wc between the two sides of the hexagonal hollow cell 3*a*. Thus, in the present disclosure, the axial width Wri of the gap between the radially inner end portions of the ribs 133, 233 and the current plate 3 is smaller than the width Wc between the two sides of the hexagonal hollow cell 3*a*. On the other hand, the axial width Wro of the gap between the radially outer end portions of the ribs 133, 233 and the current plate 3 is larger than the width Wc between the two sides of the hexagonal hollow cell 3*a*. The radially inner end portion and the radially outer end portion of the ribs 133, 233 are different from each other in the optimum value of the axial width of the gap, which improves the pressure and the air volume of the air and prevents the generation of the turbulence. The radially outer end portions of the ribs 133, 233 are easily influenced by the radially inside surfaces of the tubular units 131, 231. For this reason, the axial width Wro of the gap is increased larger than the width Wc between the two sides of the hollow cell 3*a*, which allows the improvement of the pressure-air volume characteristic of the serial axial flow fan 101.

A width of a region of the second rib 233 opposed to the current plate 3 in the axial direction is preferably less than or equal to the width Wc between the two sides of the hexagonal hollow cell 3*a*. For example, the region is the axially upper end portion of the second rib 233. For example, the width is the minimum width in the direction perpendicular to the axial direction of the second rib 233. That is, in the first modified example, the width of the region of at least one of the ribs 133, 233 opposed to the current plate 3 in the axial direction is less than or equal to the width (Wc) between the two sides of the hexagonal hollow cell 3*a*. This prevents the hexagonal hollow cell 3*a* from being blocked by at least one of the ribs 133 and 233, so that the pressure and the air volume of the air flow flowing from the first axial flow fan 1 to the second axial flow fan 2 in the current plate 3 can be improved and the generation of turbulence can be prevented.

In the first modification, the axially lower end portion of the first motor 12 is opposed to the axially upper end portion of the second motor 22 with the current plate 3 interposed therebetween. At this point, at least one of the axially lower end portion of the first motor 12 and the axially upper end portion of the second motor 22 may be in contact with the axial end surface of the current plate 3. For example, in the case that both the axially lower end portion of the first motor 12 and the axially upper end portion of the second motor 22 abut on the current plate 3, the current plate 3 can be sandwiched and held between the first motor 12 and the second motor 22. Alternatively, both the axially lower end portion of the first motor 12 and the axial upper end portion of the second motor 22 may be opposed to the axial end surface of the current plate 3 in the axial direction with a gap interposed therebetween.

Figure 9:
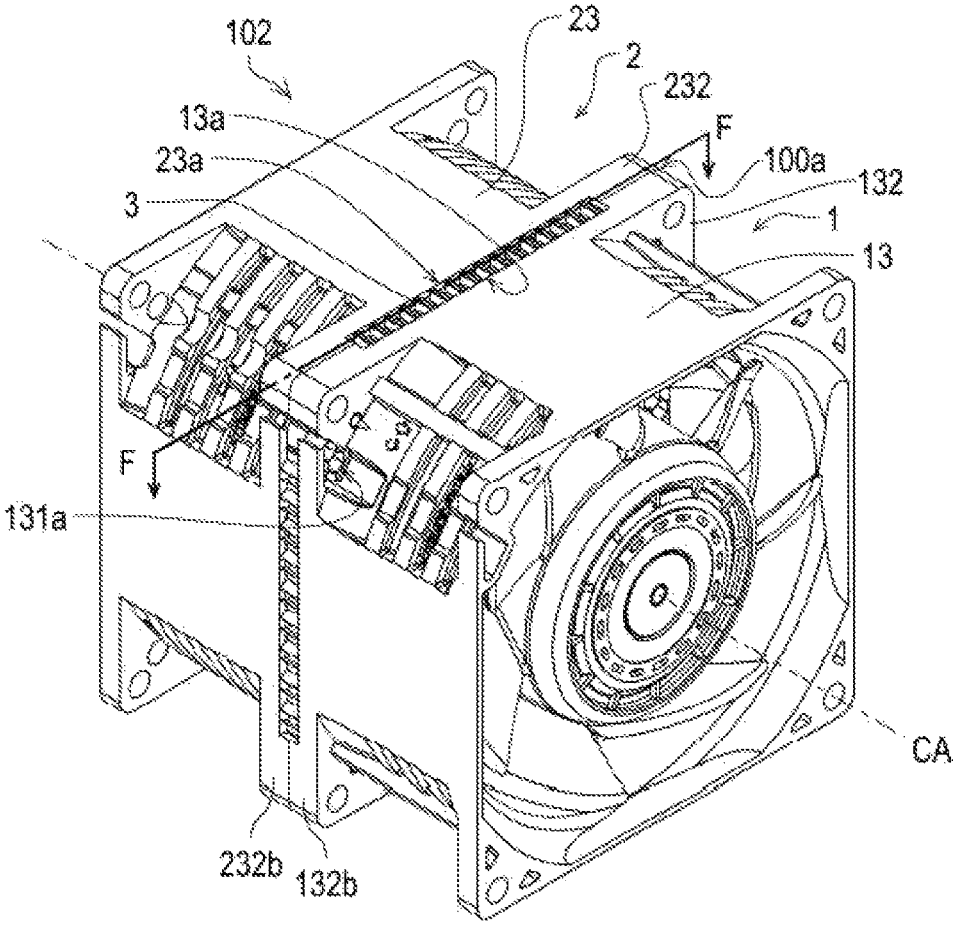
FIG. 9 is a perspective view illustrating an example of a serial axial flow fan according to a second modification of a preferred embodiment of the present disclosure.

In the embodiment and the first modification, the first opening 13*a* is provided in the first housing 13. Similarly, the second opening 23*a* may be provided in the second housing 23. FIG. 9 is a perspective view illustrating an example of a serial axial flow fan 102 according to a second modification.

The second opening 23*a* is provided in the axially upper end portion of the second housing 23, and recessed toward the axially lower side. The second opening 23*a* is provided at the same circumferential position as the first opening 13*a*. Hereinafter, the generic name of the first opening 13*a* and the second opening 23*a* is referred to as openings 13*a*, 23*a*.

The second opening 23*a* penetrates the second housing 23 in the radial direction, and particularly penetrates a part of the second tubular unit 231 and a part of the second flange 232 in the radial direction. In the second opening 23*a*, the radially outer end surface of the current plate 3 is exposed to the outside of the serial axial flow fan 102. The radially outer end portion of the current plate 3 is located at the same position as the second opening 23*a* or on the radial inside of the second opening 23*a*.

In the serial axial flow fan 102, the second opening 23*a* may be provided together with the first opening 13*a*, or the second opening 23*a* may be provided instead of the first opening 13*a*. In the case that the second opening 23*a* is provided together with the first opening 13*a*, the second opening 23*a* is preferably provided at the same circumferential position as the first opening 13*a*. As described above, in the present disclosure, in the coupling unit 100*a*, the openings 13*a*, 23*a* penetrating at least one of the first housing 13 and the second housing 23 in the radial direction are provided in at least one of the first housing 13 and the second housing 23.

At this point, in FIGS. 4A to 4C, the first opening 13*a* is covered with the belt-shaped member 4. Similarly, the second opening 23*a* may be covered with the belt-shaped member 4. Thus, in the present disclosure, the belt-shaped member 4 covers the openings 13*a*, 23*a*. Consequently, the leakage of air at the openings 13*a*, 23*a* of the coupling unit 100*a* can be reduced or prevented by the belt-shaped member 4. Thus, the pressure-air volume characteristics of the serial axial flow fan 102 can be improved. The occurrence of the noise due to the air leakage can be reduced or prevented.

More specifically, for the plurality of the openings 13*a*, 23*a*, the belt-shaped member 4 may cover all the openings 13*a*, 23*a* similarly to the case in FIG. 4A. Consequently, the leakage of air at all the openings 13*a*, 23*a* of the coupling unit 100*a* can be reduced or prevented by the belt-shaped member 4.

Alternatively, for the plurality of the openings 13*a*, 23*a*, the belt-shaped member 4 may cover some of the openings 13*a*, 23*a* similarly to the case in FIG. 4B. Consequently, only some of the plurality of openings 13*a*, 23*a* are covered with the belt-shaped member 4, so that the belt-shaped member 4 can be saved. For example, in the case that the openings 13*a*, 23*a* are adjacent to each other in installing a plurality of serial axial flow fans 102, the air leakage be reduced or prevented even if the openings 13*a*, 23*a* are not covered with the belt-shaped member 4, so that it is particularly effective.

Alternatively, similarly to the case in FIG. 4C, the belt-shaped member 4 may be wound around the entire radial circumference on radially outside surface of the coupling unit 100*a*. The belt-shaped member 4 may cover the whole of the openings 13*a*, 23*a*. Consequently, work to provide the belt-shaped member 4 is facilitated. The belt-shaped member 4 covers the whole of the openings 13*a*, 23*a*, so that the air leakage at the openings 13*a*, 23*a* can be prevented more certainly. The number of steps of tape sticking work is decreased, so that the tape sticking work is facilitated.

In the embodiment, the first modification, and the second modification, the openings 13*a*, 23*a* are provided in the housings 13, 23. However, the present invention is not limited to the embodiment, the first modification, and the second modification, but the openings 13*a*, 23*a* may not be provided in the housings 13, 23.

Figure 10:
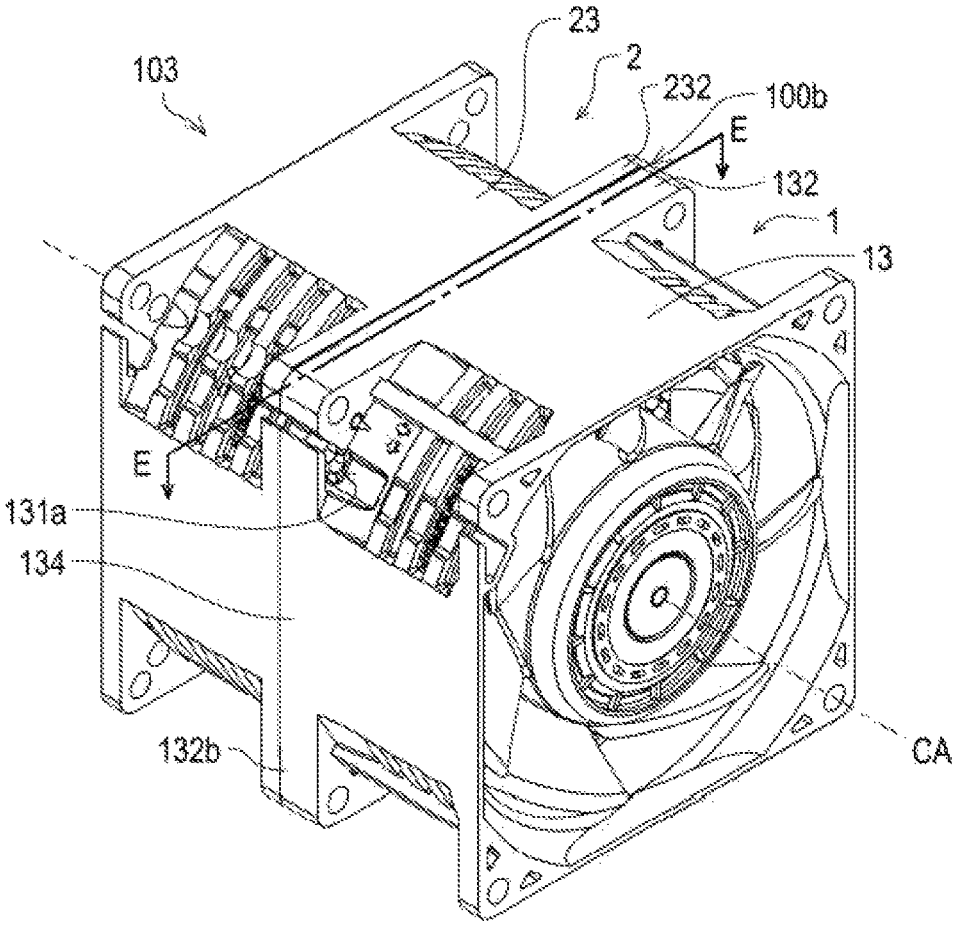
FIG. 10 is a perspective view illustrating an example of a serial axial flow fan according to a third modification of a preferred embodiment of the present disclosure.
Figure 11:
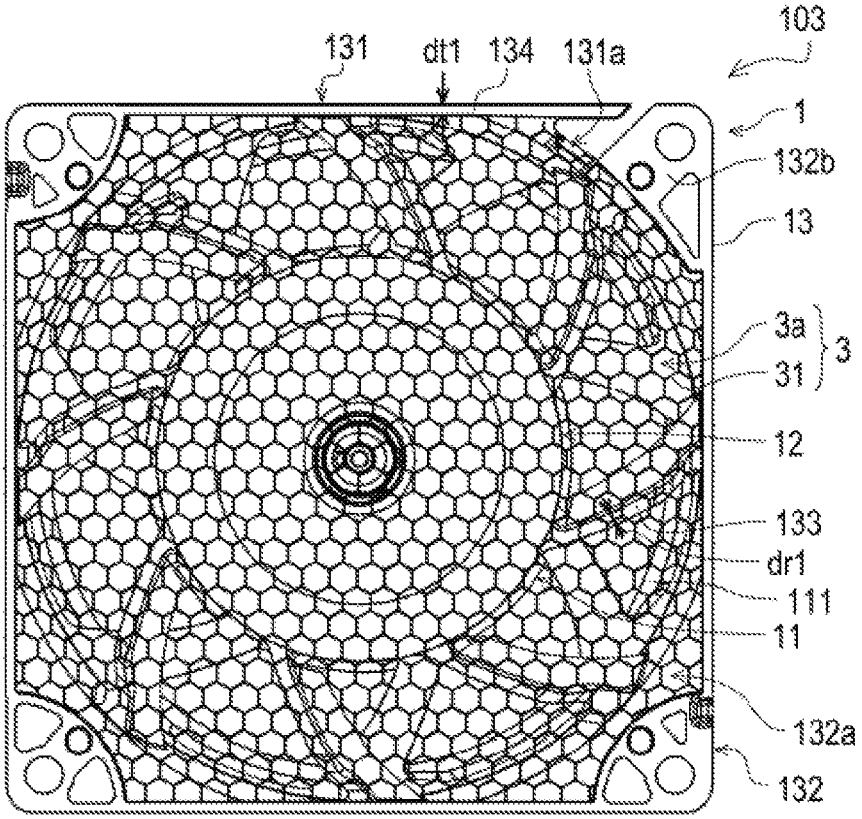
FIG. 11 is a sectional view of the serial axial flow fan taken along a one dot chain line E-E in FIG. 10.

FIG. 10 is a perspective view of a serial axial flow fan 103 according to a third modification. FIG. 11 is also a sectional view of the serial axial flow fan 103 taken along a one dot chain line E-E in FIG. 10. FIG. 10 illustrates a sectional structure obtained by cutting the serial axial flow fan 103 at a virtual plane including the center axis CA. FIG. 11 illustrates a sectional structure obtained by cutting the serial axial flow fan 103 at a virtual plane perpendicular to the axial direction.

In the third modification, the openings 13*a*, 23*a* are not provided in the housings 13, 23. On the other hand, as illustrated in FIGS. 10 and 11, the first housing 13 further includes a first wall 134. The first wall 134 is provided between the first legs 132*b* adjacent to each other in the circumferential direction. That is, one end portion in the circumferential direction of the first wall 134 is connected to one of the first legs 132*b* adjacent to each other in the circumferential direction. The other end portion in the circumferential direction of the first wall 134 is connected to the other one of the first legs 132*b* adjacent to each other in the circumferential direction.

The first wall 134 is provided in the axially lower end portion of the first housing 13, and protrudes axially downward from the radially outer end portion of the axially lower end surface of the first housing 13. The first wall 134 abuts on the axially upper end surface of the second housing 23. More specifically, in the third modification, the first wall 134 is provided on the axially lower end surface of the first tubular unit 131 and the axially lower end surface of the first flange 132. That is, a part of the first wall 134 protrudes axially downward from the radially outer end portion of the axial lower end surface of the first tubular unit 131, and abuts on the axially upper end portion of the second tubular unit 231. A remaining part of the first wall 134 protrudes axially downward from the radially outer end portion of the axially lower end surface of the first flange 132, and abuts on the axially upper end portion of the second flange 232. Consequently, the current plate 3 can be accommodated in the space between the first tubular unit 131 and the second tubular unit 231 in the axial direction and on the radial inside of the first wall 134 without exposing the radially outside surface of the current plate 3 to the outside of the first housing 13. For example, as illustrated in FIG. 11, the radially outer end portion of the current plate 3 abuts on the radially inside surface of at least a part of the first wall 134, which allows the current plate 3 to be positioned in the direction perpendicular to the axial direction.

Figure 12:
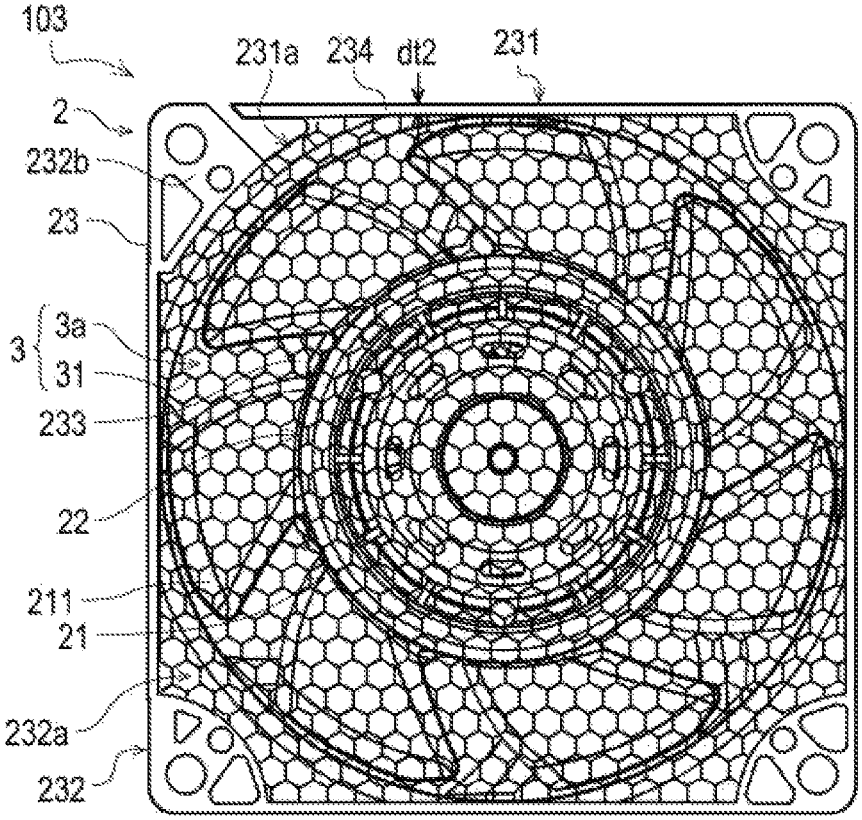
FIG. 12 is a sectional view illustrating another example of a second wall.

Similarly to the first wall 134 in FIGS. 10 and 11, the second housing 23 may include a second wall 234 as illustrated in FIG. 12. FIG. 12 is a sectional view illustrating another example of the second wall 234. For example, FIG. 12 corresponds to the sectional structure taken along a one dot chain line F-F in FIG. 9.

The second wall 234 is provided in the axially upper end portion of the second housing 23. The second wall 234 protrudes axially upward from the radially outer end portion of the axially upper end surface of the second housing 23, and abuts on the axially lower end surface of the first housing 13. For example, the second wall 234 abuts on the axially lower end surface of the first tubular unit 131 and the axially lower end surface of the first flange 132. Alternatively, the second wall 234 abuts on the axially lower end portion of the first wall 134 provided in the first housing 13 as illustrated in FIG. 12. Hereinafter, the generic name of the first wall 134 and the second wall 234 will be referred to as walls 134, 234.

As described above, in the present disclosure, the walls 134, 234 protruding in the axial direction from the radially outer end portion of at least one of the first housing 13 and the second housing 23 are provided in the axial wall of at least one of the first housing 13 and the second housing 23 on the side of the coupling unit 100*a*. The walls 134, 234 are provided between the legs 132*b*, 232*b* adjacent to each other in the circumferential direction. Consequently, one of the walls 134, 234 provided in the axial end portion of one of the housings 13, 23 abuts on the other of the housings 13, 23 or the walls 134, 234 provided in the axial end portion of the other of the housings 13, 23. This enables the current plate 3 to be accommodated in the space between the first tubular unit 131 and the second tubular unit 231 in the axial direction and on the radial inside of the walls 134, 234 without exposing the radially outside surface of the current plate 3 to the outside of the housings 13, 23. Thus, the leakage of the air flow can further be prevented in the coupling unit 100*a*. Therefore, the pressure-air volume characteristics of the serial axial flow fan 103 can be improved. The occurrence of the noise due to the air leakage can be reduced or prevented. For example, as illustrated in FIG. 11, the radially outer end portion of the current plate 3 abuts on the radially inside surface of at least a part of the walls 134, 234, which allows the current plate 3 to be positioned in the direction perpendicular to the axial direction. Thus, assembly work of the serial axial flow fan 103 is easily performed, and an assembly tolerance of the serial axial flow fan 103 can be reduced.

The exemplary embodiments are described as above in the present disclosure. The scope of the present disclosure is not limited to the present disclosure. Various modifications of the present disclosure can be made without departing from the scope of the present invention. The items described in the present disclosure can arbitrarily be combined as appropriate within a consistent range.

For example, the present disclosure is useful in an apparatus in which two axial flow fans 1, 2 are connected in series.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A serial axial flow fan comprising:

a first axial flow fan;

a second axial flow fan connected in series with the first axial flow fan; and a current plate in which a plurality of hollow cells, which are partitioned by a lattice-shaped partition wall and penetrate in an axial direction, are uniformly two-dimensionally arranged at an outer edge; wherein the first axial flow fan includes:

a first impeller including a first blade rotatable about a vertically extending center axis;

a first motor that drives the first impeller to rotate the first blade;

a first housing including a first tubular unit having an axially extending tubular shape, the first impeller and the first motor being accommodated in the first tubular unit; and a first lead wire extending from the first motor, the second axial flow fan includes:

a second impeller including a second blade rotatable about the center axis;

a second motor that drives the second impeller to rotate the second blade;

a second housing including a second tubular unit having an axially extending tubular shape, the second impeller and the second motor being accommodated in the second tubular unit; and a second lead wire extending from the second motor;

an axially lower end portion of the first housing and the axially upper end portion of the second housing are directly coupled to each other;

the current plate is provided at a coupling unit of the first housing and the second housing;

an axially lower end portion of the first tubular unit is axially opposed to an axially upper end portion of the second tubular unit with the current plate interposed therebetween;

a recess recessed in an opposite direction to the coupling unit in the axial direction is provided on an axial end surface of at least one of the axially lower end surface of the first tubular unit and the axially upper end surface of the second tubular unit;

at least one of the first lead wire and the second lead wire is accommodated in the recess; and at least a portion of the recess overlaps a portion of the current plate in the axial direction.

2. The serial axial flow fan according to claim 1, wherein when viewed in the axial direction, a radially outer end of the current plate is located at a position identical to a radially outer end of the recess or a position on a radial inside of the radially outer end of the recess.

3. The serial axial flow fan according to claim 1, wherein the first housing includes a first flange expanding radially outward from an axial end portion of the first tubular unit on a coupling unit side;

the second housing includes a second flange expanding radially outward from an axial end portion of the second tubular unit on the coupling unit side; and a leg protruding in the axial direction is provided on an axial end surface of at least one of the first flange and the second flange on the coupling unit side.

4. The serial axial flow fan according to claim 3, wherein when viewed in the axial direction, the leg is provided on a radial outside of the recess.

5. The serial axial flow fan according to claim 3, wherein an axial length of the leg is less than or equal to an axial length of the current plate.

6. The serial axial flow fan according to claim 3, wherein a plurality of flanges in each of which the leg is located are provided in a circumferential direction;

a wall protruding in the axial direction from a radially outer end portion of at least one of the first housing and the second housing is provided in an axial end portion of at least one of the first housing and the second housing on the coupling unit side; and the wall is provided between the legs adjacent to each other in the circumferential direction.

7. The serial axial flow fan according to claim 3, wherein a planar unit abutting on an axial end surface of the current plate is provided in the first flange and the second flange.

8. The serial axial flow fan according to claim 1, wherein the current plate has a honeycomb structure in which the hollow cells are hexagonal and two-dimensionally arranged when viewed in the axial direction; and a width between two sides of the hexagonal hollow cell is larger than radial widths of axial end portions of the first tubular unit and the second tubular unit on the coupling unit side, the two sides being opposed to each other and extending parallel or substantially parallel to each other.

9. The serial axial flow fan according to claim 8, wherein an opening ratio of the hollow cell of the current plate having the honeycomb structure is greater than or equal to about 90%.

10. The serial axial flow fan according to claim 9, wherein the first housing further includes a first rib that supports the first motor in a radially inner end portion of the first rib, a radially outer end portion of the first rib being connected to the first tubular unit;

the second housing further includes a second rib that supports the second motor in a radially inner end portion of the second rib, a radially outer end portion of the second rib being connected to the second tubular;

at least one of the first rib and the second rib is axially opposed to the current plate with a gap interposed therebetween; and a minimum axial width of the gap is narrower than a width between the two sides of the hexagonal hollow cell of the current plate having the honeycomb structure.

11. The serial axial flow fan according to claim 10, wherein a width of a region in which at least one of the first rib and the second rib is axially opposed to the current plate is less than or equal to the width between the two sides of the hexagonal hollow cell.

12. The serial axial flow fan according to claim 10, wherein the axial width of the gap between the radially inner end portion of the at least one rib and the current plate is smaller than the width between the two sides of the hexagonal hollow cell; and the axial width of a gap between the radially outer end portion of the at least one rib and the current plate is larger than the width between the two sides of the hexagonal hollow cell.

13. The serial axial flow fan according to claim 1, further comprising a belt provided in a radially outside surface of the coupling unit; wherein in the coupling unit, an opening radially penetrating at least one of the first housing and the second housing is provided in at least one of the first housing and the second housing; and the belt covers the opening.

14. The serial axial flow fan according to claim 13, wherein a plurality of the openings are provided; and the belt covers a portion of the plurality of openings.

15. The serial axial flow fan according to claim 13, wherein the belt is wound around an entire circumference in a circumferential direction on a radially outside surface of the coupling unit, and covers an entirety of the opening.

* * * * *